US007225901B2

(12) United States Patent
Mustalahti et al.

(10) Patent No.: US 7,225,901 B2
(45) Date of Patent: Jun. 5, 2007

(54) ELEVATOR ROPING SYSTEM

(75) Inventors: Jorma Mustalahti, Hyvinkää (FI); Esko Aulanko, Kerava (FI)

(73) Assignee: Kone Corporation, Helsinki (FI)

( * ) Notice: Subject to any disclaimer, the term of this patent is extended or adjusted under 35 U.S.C. 154(b) by 57 days.

(21) Appl. No.: 11/097,181

(22) Filed: Apr. 4, 2005

(65) Prior Publication Data

US 2006/0231345 A1 Oct. 19, 2006

Related U.S. Application Data

(63) Continuation of application No. PCT/FI03/000713, filed on Oct. 1, 2003.

(30) Foreign Application Priority Data

Nov. 4, 2002 (FI) ..... 20021959

(51) Int. Cl.
*B66B 11/08* (2006.01)

(52) U.S. Cl. ..... 187/266; 187/251; 187/262; 187/264; 187/412

(58) Field of Classification Search ..... 187/251, 187/262, 266, 264
See application file for complete search history.

(56) References Cited

U.S. PATENT DOCUMENTS 4,620,615 A * 11/1986 Morris et al. ..... 187/264
4,756,388 A * 7/1988 Heikkinen ..... 187/266
4,952,249 A * 8/1990 Dambre ..... 205/210
5,370,205 A * 12/1994 Vanhala ..... 187/264
5,513,724 A * 5/1996 De Jong ..... 187/264
6,364,061 B2 * 4/2002 Baranda et al. ..... 187/254
2003/0089551 A1 * 5/2003 Kato et al. ..... 182/1
2004/0035645 A1 * 2/2004 Orrmann ..... 187/266
2004/0129501 A1 * 7/2004 Wittur et al. ..... 187/254
2006/0225965 A1 * 10/2006 Siewert et al. ..... 187/250

FOREIGN PATENT DOCUMENTS

FR 2 823 734 A1 4/2001
FR 2823734 A1 * 10/2002

* cited by examiner

*Primary Examiner*—Gene O. Crawford
*Assistant Examiner*—Stefan Kruer
(74) *Attorney, Agent, or Firm*—Harness, Dickey & Pierce, P.L.C.

(57) ABSTRACT

An elevator, preferably an elevator without machine room, in which the hoisting machine (10) engages the hoisting ropes (3) by means of a traction sheave (11), the elevator car (1) being at least partially supported by the hoisting ropes serving as a means of moving the elevator car (1). The elevator car is suspended on the hoisting ropes (3) by means of at least one diverting pulley (13,14) from whose rim the hoisting ropes go upwards from both sides and at least one diverting pulley (7,5) from whose rim the hoisting ropes go downwards from both sides of the diverting pulley. The traction sheave (11) engages the rope portion between these diverting pulleys (13,5).

24 Claims, 11 Drawing Sheets

ELEVATOR ROPING SYSTEM

This application is a continuation of, and claims priority under 35 U.S.C. §120 and 35 U.S.C. §365(c) from, PCT International Application No. PCT/FI2003/000713 which has an International filing date of Oct. 01, 2003, which designated the United States of America and which claims priority on FINLAND Application Priority Number 20021959 filed Nov. 4, 2002, the entire contents of all of which are hereby incorporated herein by reference.

Example embodiments relates to an elevator roping system.

BACKGROUND

One of the objectives in elevator development work is to achieve efficient and economical utilization of building space. In recent years, this development work has produced various elevator solutions without machine room, among other things. Good examples of elevators without machine room are disclosed in specifications EP 0 631 967 (A1) and EP 0 631 968. The elevators described in these specifications are fairly efficient in respect of space utilization as they have made it possible to eliminate the space required by the elevator machine room in the building without a need to enlarge the elevator shaft. In the elevators disclosed in these specifications, the machine is compact at least in one direction, but in other directions it may have much larger dimensions than a conventional elevator machine.

In these basically good elevator solutions, the space required by the hoisting machine limits the freedom of choice in elevator lay-out solutions. Space is needed for the arrangements required for the passage of the hoisting ropes. It is difficult to reduce the space required by the elevator car itself on its track and likewise the space required by the counterweight, at least at a reasonable cost and without impairing elevator performance and operational quality. In a traction sheave elevator without machine room, mounting the hoisting machine in the elevator shaft is often difficult, especially in a solution with machine above, because the hoisting machine is a sizeable body of considerable weight. Especially in the case of larger loads, speeds and/or hoisting heights, the size and weight of the machine are a problem regarding installation, even so much so that the required machine size and weight have in practice limited the sphere of application of the concept of elevator without machine room or at least retarded the introduction of said concept in larger elevators. In modernization of elevators, the space available in the elevator shaft often limits the area of application of the concept of elevator without machine room. In many cases, especially when hydraulic elevators are modernized or replaced, it is not practical to apply the concept of roped elevator without machine room due to insufficient space in the shaft, especially in a case where the hydraulic elevator solution to be modernized/replaced has no counterweight. A disadvantage with elevators provided with a counterweight is the cost of the counterweight and the space it requires in the shaft. Drum elevators, which are nowadays rarely used, have the drawbacks of requiring heavy and complex hoisting machines with a high power consumption.

SUMMARY

An example embodiment discloses an elevator without machine room further so as to allow more effective space utilization in the building and elevator shaft than before.

This means that the elevator maybe installed in a fairly narrow elevator shaft if necessary. On the other hand, another aim of the invention to reduce the size and/or weight of the elevator or at least its machine. One objective is to achieve an elevator in which the hoisting rope of an elevator with thin hoisting rope and/or a small traction sheave has a good grip/contact on the traction sheave. A further aim of the invention is to achieve an elevator solution without counterweight without compromising on the properties of the elevator.

The object of the invention should be achieved without compromising the possibility of varying the basic lay-out of the elevator.

By applying the invention, one or more of the following advantages, among others, can be achieved:

- Using a small traction sheave, a very compact elevator and/or elevator machine is achieved
- The small coated traction sheave used allows the weight of the machine to be easily reduced even to about half of the weight of the machines now generally used in elevators without machine room. For example, in the case of elevators designed for a nominal load below 1000 kg, this means machines weighing 100–150 kg or even less. Via appropriate motor solutions and choices of materials, it is even possible to achieve machines having a weight below 100 kg or even as small as about 50 kg.
- A good traction sheave grip, which is achieved in particular by using Double Wrap roping, and lightweight components allow the weight of the elevator car to be considerably reduced.
- A compact machine size and thin, substantially round ropes permit the elevator machine to be relatively freely placed in the shaft. Thus, the elevator solution of the invention can be implemented in a fairly wide variety of ways in the case of both elevators with machine above and elevators with machine below.
- The elevator machine can be advantageously placed between the car and a shaft wall.
- All or at least part of the weight of the elevator car can be carried by the elevator guide rails.
- In elevators applying the invention, a centric suspension arrangement of the elevator car can be readily achieved, thereby reducing the lateral supporting forces applied to the guide rails.
- Applying the invention allows effective utilization of the cross-sectional area of the shaft.
- The invention reduces the installation time and total installation costs of the elevator.
- The elevator is economical to manufacture and install because many of its components are smaller and lighter than those used before.
- The speed governor rope and the hoisting rope are usually different in respect of their properties and they can be easily distinguished from each other during installation if the speed governor rope is thicker than the hoisting ropes; on the other hand, the speed governor rope and the hoisting ropes may also be of identical structure, which will reduce ambiguities regarding these matters in elevator delivery logistics and installation.
- The light, thin ropes are easy to handle, allowing considerably faster installation.
- E.g. in elevators for a nominal load below 1000 kg, the thin and strong steel wire ropes of the invention have a diameter of the order of only 3–5 mm, although thinner and thicker ropes may also be used.

With rope diameters of about 6 mm or 8 mm, fairly large and fast elevators according to the invention can be achieved.

The traction sheave and the rope pulleys are small and light as compared with those used in conventional elevators.

The small traction sheave allows the use of smaller operating brakes.

The small traction sheave reduces the torque requirement, thus allowing the use of a smaller motor with smaller operating brakes.

Because of the smaller traction sheave, a higher rotational speed is needed to achieve a given car speed, which means that the same motor output power can be reached by a smaller motor.

Either coated or uncoated ropes can be used.

It is possible to implement the traction sheave and the rope pulleys in such a way that, after the coating on the pulley has been worn out, the rope will bite firmly on the pulley and thus a sufficient grip between rope and pulley in this emergency is maintained.

The use of a small traction sheave makes it possible to use a smaller elevator drive motor, which means a reduction in drive motor acquisition/manufacturing costs.

The invention can be applied in gearless and geared elevator motor solutions.

Although the invention is primarily intended for use in elevators without machine room, it can also be applied in elevators with machine room.

In the invention a better grip and a better contact between the hoisting ropes and the traction sheave are achieved by increasing the contact angle between them.

Due to the improved grip, the size and weight of the car can be reduced.

The space saving potential of the elevator of the invention is increased considerably as the space required by the counterweight is at least partially eliminated.

In the elevator of the invention, a lighter and smaller machine and/or motor can be used As a result of the lighter and smaller elevator system, energy savings and at the same time cost savings are achieved.

The placement of the machine in the shaft can be relatively freely chosen as the space required by the counterweight and counterweight guide rails can be used for other purposes By mounting at least the elevator hoisting machine, the traction sheave and a rope sheave functioning as a diverting pulley in a complete unit, which is fitted as a part of the elevator of the invention, considerable savings in installation time and costs will be achieved.

In the elevator solution of the invention, it is possible to dispose all ropes in the shaft on one side of the elevator car; for example, in the case of rucksack type solutions, the ropes can be arranged to run behind the elevator car in the space between the elevator car and the back wall of the elevator shaft.

The invention makes it easy to implement scenic-type elevator solutions as well.

Since the elevator solution of the invention does not necessarily comprise a counterweight, it is possible to implement elevator solutions in which the elevator car has doors in several walls, in an extreme case even in all the walls of the elevator car. In this case, the elevator car guide rails are disposed at the corners of the elevator car.

The elevator solution of the invention can be implemented with several different machine solutions.

The suspension of the car can be implemented using almost any suitable suspension ratio.

One area of application of the invention is elevators designed for the transportation of people and/or freight. A typical area of application of the invention is in elevators whose speed range is about 1 m/s or below but may also be higher. For example, an elevator having a traveling speed of 0.6 m/s is easy to implement according to the invention.

In both passenger and freight elevators, many of the advantages achieved through the invention are pronouncedly brought out even in elevators for only 2–4 people, and distinctly already in elevators for 6–8 people (500–630 kg).

An example embodiment discloses an elevator, having normal elevator hoisting ropes, such as generally used steel ropes, are applicable. In the elevator, it is possible to use ropes made of artificial materials and ropes in which the load-bearing part is made of artificial fiber, such as e.g. so-called "aramid ropes", which have recently been proposed for use in elevators. Applicable solutions include also steel-reinforced flat ropes, especially because they allow a small deflection radius. Particularly well applicable in the elevator of the invention are elevator hoisting ropes twisted e.g. from round and strong wires. From round wires, the rope can be twisted in many ways using wires of different or equal thickness. In ropes well applicable in the invention, the wire thickness is below 0.4 mm on an average. Well applicable ropes made from strong wires are those in which the average wire thickness is below 0.3 mm or even below 0.2 mm. For instance, thin wired and strong 4 mm ropes can be twisted relatively economically from wires such that the mean wire thickness in the finished rope is in the range of 0.15–0.25 mm, while the thinnest wires may have a thickness as small as only about 0.1 mm. This rope wires can easily be made very strong. In the invention, rope wires having a strength greater than 2000 $N/mm^2$ are used. A suitable range of rope wire strength is 2300–2700 $N/mm^2$. In principle, it is possible to use rope wires having a strength of up to about 3000 $N/mm^{2-}$ or even more.

Another example embodiment discloses an elevator without machine room, in which elevator the hoisting machine engages the hoisting ropes by means of a traction sheave. The elevator car being at least partially supported by said hoisting ropes, which serve as transmission means for moving the elevator car. The elevator car is connected to the hoisting ropes via at least one diverting pulley from the rim of which the hoisting ropes go downwards from both sides of the diverting pulley, and in which elevator the traction sheave engages the rope portion between these diverting pulleys.

By increasing the contact angle by means of a rope sheave functioning as a diverting pulley, the grip between the traction sheave and the hoisting ropes can be increased. In this way, the car can be made lighter and its size can be reduced, thus increasing the space saving potential of the elevator. A contact angle of over 180° between the traction sheave and the hoisting rope is achieved by using one or more diverting pulleys.

BRIEF DESCRIPTION OF THE DRAWINGS

In the following, the invention will be described in detail by the aid of a few examples of its embodiments with reference to the attached drawings, wherein.

DETAILED DESCRIPTION OF EXAMPLE EMBODIMENTS

Figure 1:
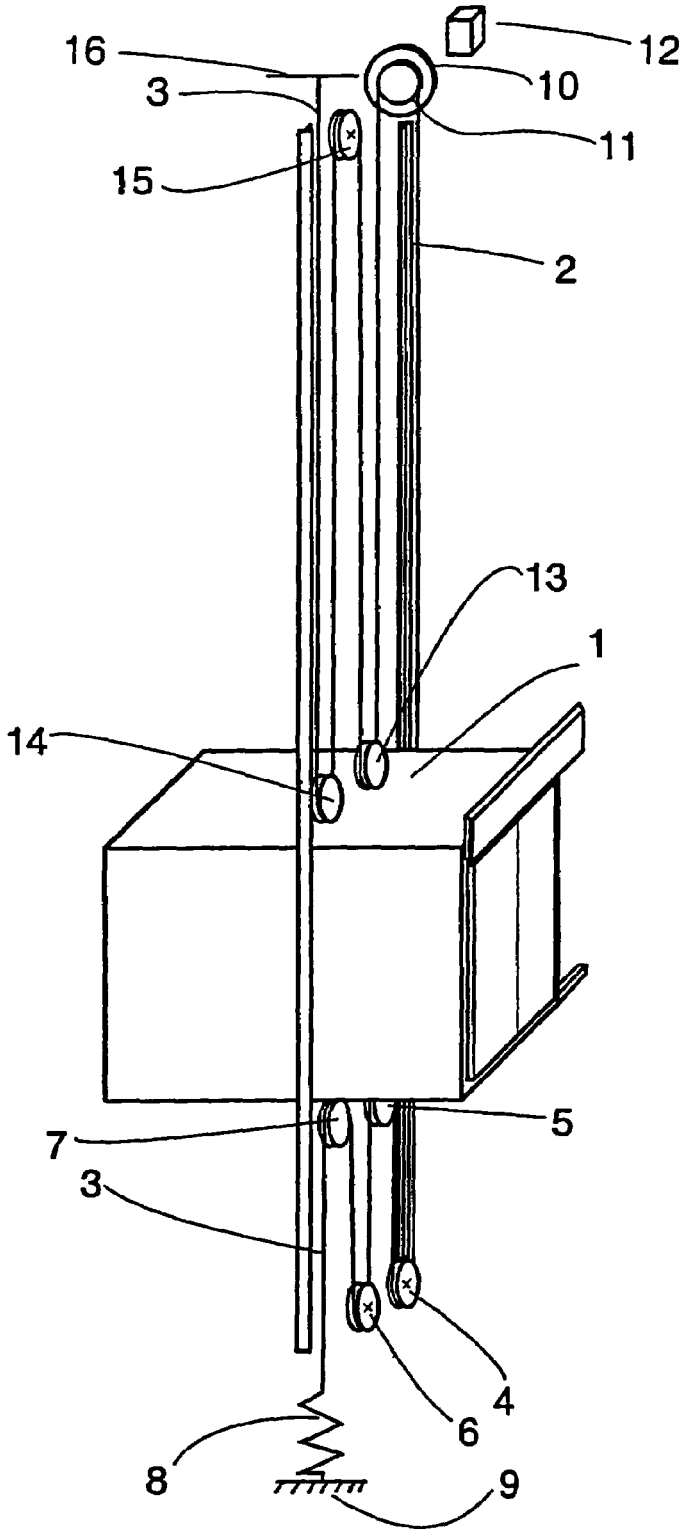
FIG. 1 presents a diagram representing a traction sheave elevator according to the invention, FIG. 2. presents a diagram representing a second traction sheave elevator according to the invention, FIG. 3. presents a diagram representing a third traction sheave elevator according to the invention.

FIG. 1 presents a diagrammatic illustration of the structure of the elevator. The elevator is preferably an elevator without machine room, with a drive machine 10 placed in the elevator shaft. The elevator shown in the figure is a traction sheave elevator without counterweight and with machine above. The passage of the hoisting ropes 3 of the elevator is as follows: One end of the ropes is immovably fixed to an anchorage 16 in the upper part of the shaft, from where the ropes 3 go further to a diverting pulley 15 placed in the upper part of the shaft and from which diverting pulley 15 the ropes go further to a diverting pulley 13 placed above the elevator car, from which diverting pulley 13 the ropes go further to upwards to the traction sheave 11 of the drive machine 10, passing around it along the rope grooves of the traction sheave. From the traction sheave 11, the ropes 3 go further downwards past the elevator car 1 moving along the elevator guide rails 2 to a diverting pulley 4 placed in the lower part of the shaft, going further from diverting pulley 4 to a diverting pulley below the elevator car, from where the ropes 3 go further to a diverting pulley 6 in the lower part of the elevator shaft and then further to a diverting pulley 7 below the elevator car, from where the ropes 3 go further to an anchorage 9 in the lower part of the elevator shaft, to which the other end of the ropes 3 is immovably secured. At the lower anchorage of the hoisting rope 3 there is also rope tensioning element 8, by means of which the rope tension can be adjusted. The tensioning element 8 may be e.g. a spring or a weight hanging freely at the end of the rope or some other appropriate tensioning element solution. In a preferred case, the drive machine 10 may be fixed e.g. to a car guide rail, and the diverting pulley 15 in the upper part of the shaft is mounted on the beams in the upper part of the shaft, which are fastened to the car guide rails 2. The diverting pulleys 5, 7, 13, 14 on the elevator car are mounted on beams above and below the car. The diverting pulleys in the lower part of the shaft are preferably mounted on the shaft floor. In FIG. 1, the traction sheave engages the rope portion between diverting pulleys 13 and 5, which is a preferable solution according to the invention.

The drive machine 10 placed in the elevator shaft is preferably of a flat construction, in other words, the machine has a small thickness dimension as compared with its width and/or height, or at least the machine is slim enough to be accommodated between the elevator car and a wall of the elevator shaft. The machine may also be placed differently, e.g. by disposing the slim machine partly or completely between an imaginary extension of the elevator car and a shaft wall. In the elevator of the invention, it is possible to use a drive machine 10 of almost any type and design that fits into the space intended for it. For example, it is possible to use a geared or a gearless machine. The machine may be of a compact and/or flat size. In the suspension solutions according to the invention, the rope speed is often high as compared to the speed of the elevator, so it is possible to use even unsophisticated machine types as the basic machine solution. The elevator shaft is advantageously provided with equipment required for the supply of power to the motor driving the traction sheave 11 as well as equipment needed for elevator control, both of which can be placed in a common instrument panel 12 or mounted separately from each other or integrated partly or completely with the drive machine 10. A preferable solution is a gearless machine comprising a permanent magnet motor. The drive machine may be fixed to a wall of the elevator shaft, to the ceiling, to a guide rail or to some other structure, such as a beam or frame. In the case of an elevator with machine below, a further possibility is to mount the machine on the bottom of the elevator shaft. FIG. 1 illustrates a preferred suspension solution in which the suspension ratio of the diverting pulleys above the elevator car and the diverting pulleys below the elevator car is the same 4:1 suspension in both cases. Other suspension solutions can also be used to implement the invention. The elevator presented in the figure has automatic telescoping doors, but other types of automatic doors or turning doors may also be used within the framework of the invention. The elevator of the invention can also be implemented as a solution comprising a machine room, or the machine may be mounted to be movable together with the elevator. In the invention, the diverting pulleys connected to the elevator car may be preferably mounted on one and the same beam, which supports both the diverting pulleys above the car and the diverting pulleys below the car. This beam may be fitted on top of the car, on the side of the car or below the car, on the car frame or in some other appropriate place in the car structure. The diverting pulleys may also be fitted each one separately in appropriate places on the car and in the shaft.

Figure 2:
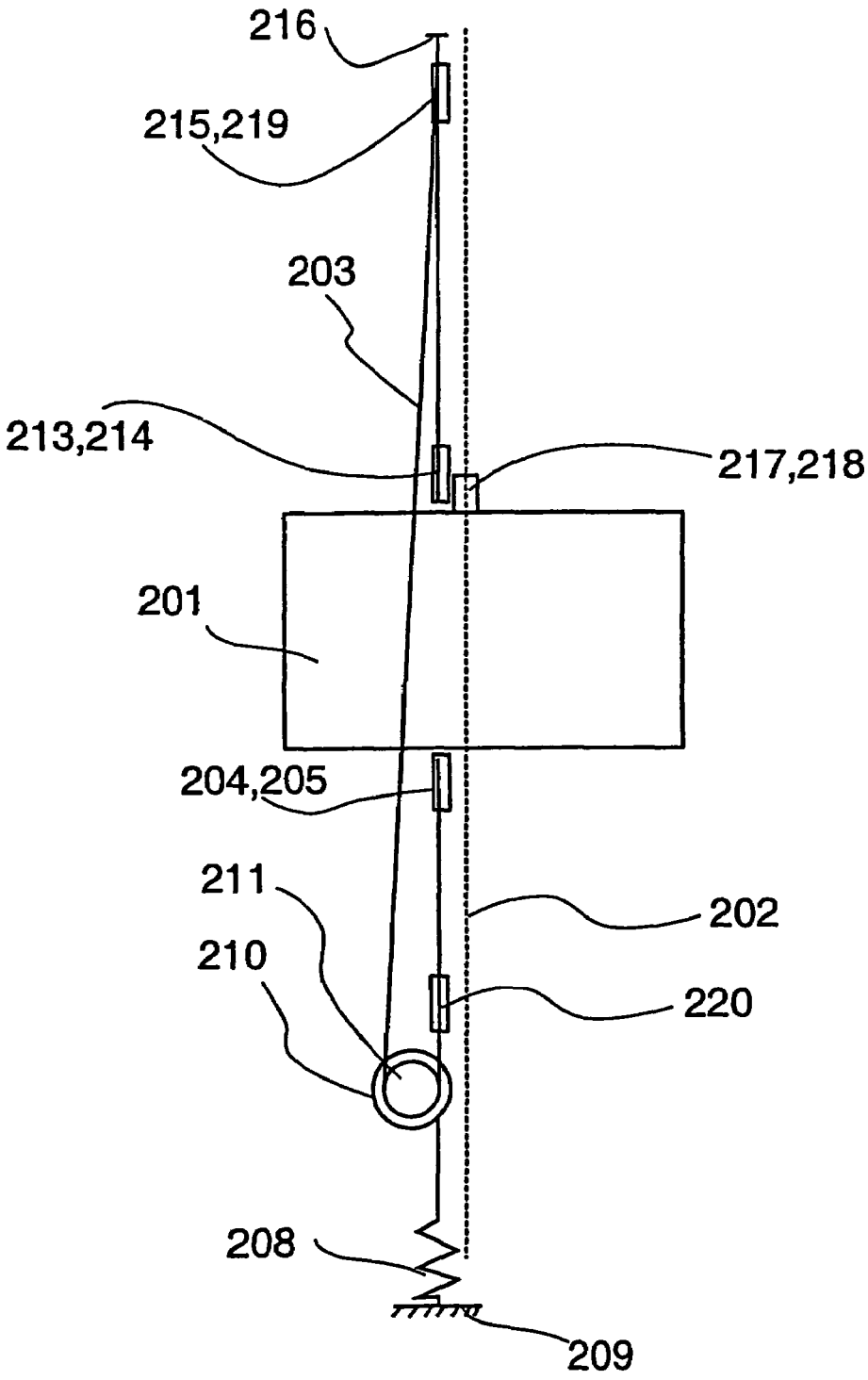

FIG. 2 presents a diagram representing another traction sheave elevator according to the invention. In this elevator, the ropes go upward from the machine. This type of elevator is generally a traction sheave elevator with machine below. The elevator car 201 is suspended on the hoisting ropes 203 of the elevator. The elevator drive machine unit 210 is mounted in the elevator shaft, preferably in the lower part of the shaft. The elevator car 201 moves in the elevator shaft along an elevator guide rail 202 guiding it.

In FIG. 2, the hoisting ropes run as follows: One end of the ropes is fixed to an anchorage 216 in the upper part of the shaft, from where it goes downward to a diverting pulley 213, from which the ropes go further upward to a first diverting pulley 215 mounted in the upper part of the shaft and from diverting pulley 215 to a diverting pulley 214 on the elevator car 201, from where it returns to a diverting pulley 219 in the upper part of the shaft. From diverting pulley 219, the hoisting ropes go further to the traction sheave 211 driven by the drive machine 210. From the traction sheave, the ropes go again upwards to a diverting pulley 204 mounted below the car, and having wrapped around it the hoisting ropes run via a diverting pulley 220 mounted in the lower part of the elevator shaft back to a second diverting pulley 205 below the car, from where the ropes go further to an anchorage 209 in the lower part of the elevator shaft, where the other end of the hoisting ropes is fixed. A rope tensioning element 208 is also provided at the lower rope anchorage. The elevator presented in FIG. 2 is a traction sheave elevator with machine below, in which the suspension ratio both above and below the car is 4:1. In addition, a smaller shaft space is needed above or below the elevator car because the rope sheaves used as diverting pulleys have small diameters as compared with earlier solutions, depending on how the rope sheaves are mounted on the elevator car and/or the frame of the elevator car.

Figure 3:
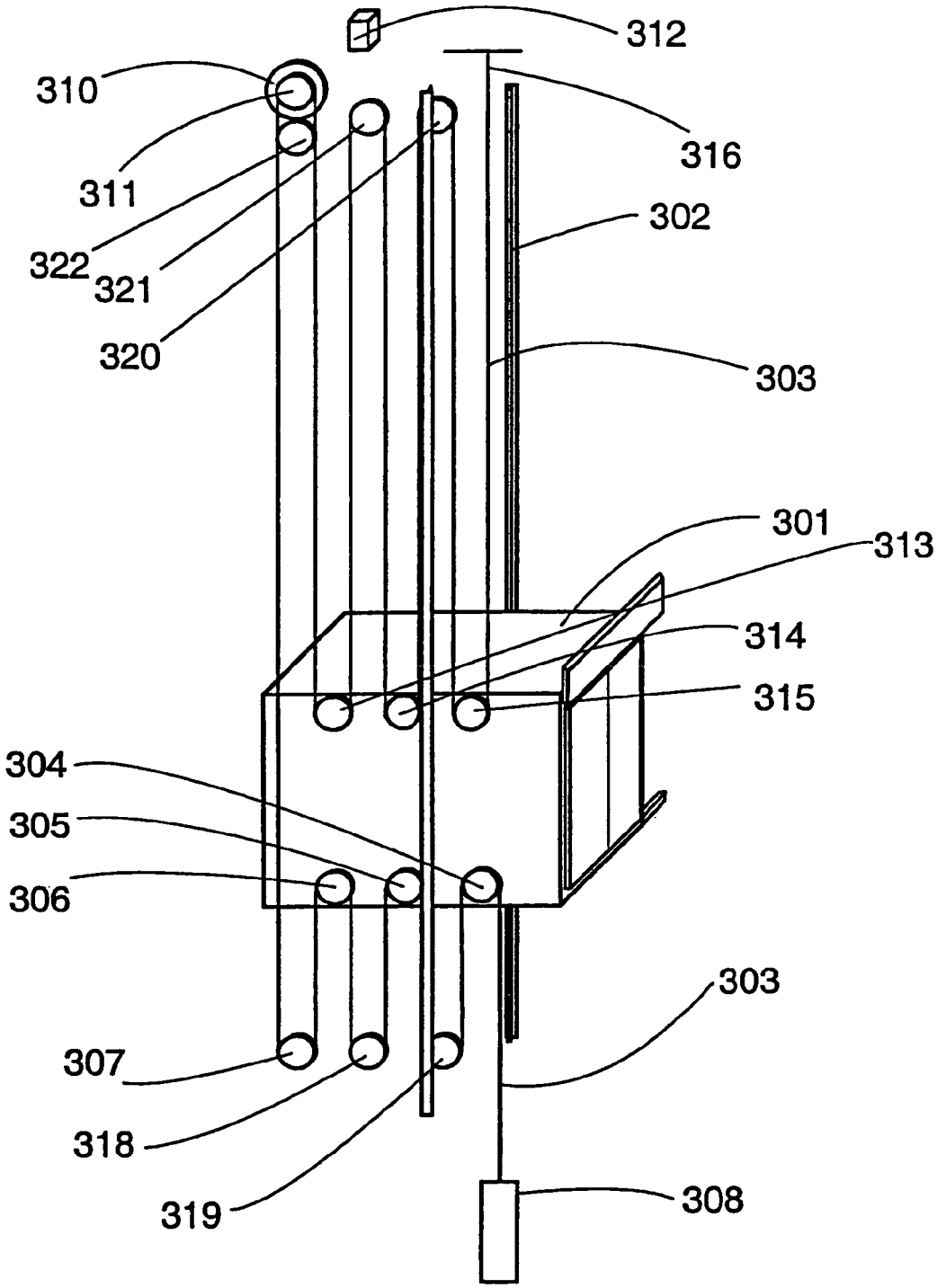

FIG. 3 presents a diagrammatic illustration of the structure of an elevator according to the invention. The elevator is preferably an elevator without machine room, with a drive machine 310 placed in the elevator shaft. The elevator shown in FIG. 3 is a traction sheave elevator with machine above, in which the suspension ratio above and below the elevator car is 6:1. The passage of the hoisting ropes 303 of the elevator is as follows: One end of the ropes 303 is immovably fixed to an anchorage 316 in the upper part of the shaft, from where the ropes run downwards to a diverting pulley 315 mounted at the side of the elevator car, from where the ropes run further to the upper part of the elevator shaft, passing around a diverting pulley 320, from which the ropes 303 go further downwards to diverting pulley 314, from which they return downwards to diverting pulley 313. Via the rope grooves of diverting pulley 313, the hoisting ropes run further upwards to the traction sheave 311 of the drive machine 310, passing around the traction sheave along the rope grooves on the sheave. From the traction sheave 311, the ropes 303 run further downwards to diverting pulley 322, wrapping around it along the rope grooves of the diverting pulley and then returning back up to the traction sheave 311, over which the ropes run in the traction sheave rope grooves. From the traction sheave 311, the ropes 303 go further downwards via the rope grooves of diverting pulley 322 to a diverting pulley 307 placed in the lower part of the elevator shaft, from where they go further to the elevator car 301 moving along the car guide rails 302 of the elevator and to a diverting pulley 306 mounted at its lower edge. The ropes are passed between the diverting pulleys 318, 319 in the lower part of the elevator shaft and the diverting pulleys 306, 305, 304 in the lower part of the elevator car as many times as necessary to achieve the same suspension ratio for the portion above the elevator car and the portion below the car. After this, the rope goes downwards to an anchorage element 308, e.g. a weight, which functions as a rope tensioning element hanging freely at the other end of the rope. In the case presented in the figure, the hoisting machine and the diverting pulleys are preferably all placed on one and the same side of the elevator car. This solution is particularly advantageous in the case of a rucksack elevator solution, in which case the above-mentioned components are disposed behind the elevator car, in the space between the back wall of the elevator car and the back wall of the shaft. In a rucksack solution like this, the elevator guide rails 302 may preferably be disposed e.g. in the frontmost part of the elevator car at the sides of the elevator car/elevator car frame. The roping arrangement between the traction sheave 311 and the diverting pulley 322 is referred to as Double Wrap roping, wherein the hoisting ropes are wrapped around the traction sheave two and/or more times. In this way, the contact angle can be increased in two and/or more stages. For example, in the embodiment presented in FIG. 3, a contact angle of 180°+180°, i.e. 360° between the traction sheave 311 and the hoisting ropes 303 is achieved. The Double Wrap roping presented in the figure can also be arranged in another way, e.g. by placing the diverting pulley on the side of the traction sheave, in which case, as the hoisting ropes pass twice around the traction sheave, a contact angle of 180°+90°=270° is achieved, or by placing the traction sheave in some other appropriate location. A preferable solution is to dispose the traction sheave 311 and the diverting pulley 322 in such a way that the diverting pulley 322 will also function as a guide of the hoisting ropes 303 and as a damping wheel. Another advantageous solution is to build a complete unit comprising both an elevator drive machine with a traction sheave and one or more diverting pulleys with bearings in a correct operating angle relative to the traction sheave to increase the contact angle. The operating angle is determined by the roping used between the traction sheave an the diverting pulley/diverting pulleys, which defines the way in which the mutual positions and angle between the traction sheave and diverting pulley/diverting pulleys relative to each other are fitted in the unit. This unit can be mounted in place as a unitary aggregate in the same way as a drive machine. The drive machine may be fixed to a wall of the elevator shaft, to the ceiling, to a guide rail or guide rails or to some other structure, such as a beam or frame. In Double Wrap roping, when the diverting pulley is of substantially equal size with the traction sheave, the diverting pulley can also function as a damping wheel. In this case, the ropes going from the traction sheave to the counterweight and to the elevator car are passed via the rope grooves of the diverting pulley and the rope deflection caused by the diverting pulley is very small. It could be said that the ropes coming from the traction sheave only touch the diverting pulley tangentially. Such tangential contact serves as a solution damping the vibrations of the outgoing ropes and it can be applied in other roping solutions as well.

Figure 4:
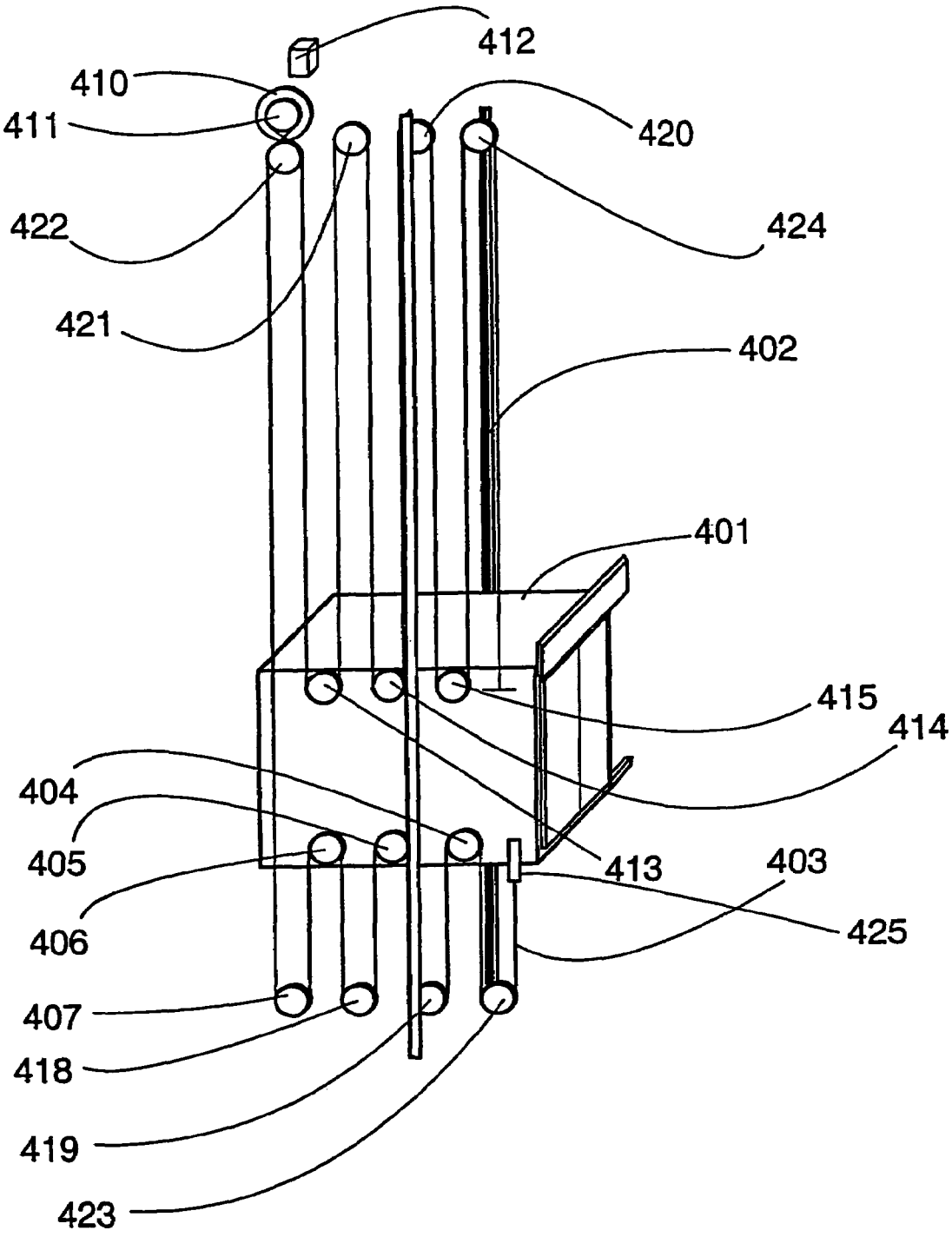
FIG. 4 presents a diagram representing a traction sheave elevator according to the invention.

FIG. 4 presents a diagrammatic illustration of the structure of a fourth elevator according to the invention. The elevator is preferably an elevator without machine room, with a drive machine 410 placed in the elevator shaft. The elevator shown in FIG. 4 is a traction sheave elevator with machine above and having a suspension ratio of 7:1 above and below the elevator car, which is a very advantageous implementation of the invention in respect of suspension ratio. The passage of the hoisting ropes is mainly similar to that in FIG. 3, but in this figure the starting point of the hoisting ropes 403 is on the elevator car 401, to which the rope is substantially immovably secured. With this arrangement, an odd suspension ratio is achieved for the portion above the elevator car. A further difference from FIG. 3 is that the number of diverting pulleys mounted in the upper part of the elevator shaft larger by one than in FIG. 3. The passage of ropes to the hoisting machine 410 follows the same principle as in FIG. 3. From the hoisting machine 410, hoisting rope runs between the diverting pulleys 407, 418, 419, 423 in the lower part of the elevator shaft and the diverting pulleys 406, 405, 404 mounted below the elevator car on the same principle as in FIG. 3. In the portion below the elevator car, the same suspension ratio, i.e. an odd suspension ratio of 7:1, is achieved by fixing the ropes to an anchorage 425 on the elevator car 401. Placed at this fixing point is also a rope tensioning element. In FIG. 4 there is also a difference from FIG. 3 in respect of the roping between the traction sheave 411 and the diverting pulley 422. The roping arrangement presented in FIG. 4 can also be called X Wrap (XW) roping. Previously known concepts are Double Wrap (DW) roping, Single Wrap (SW) roping and Extended Single Wrap (ESW) roping. In X Wrap roping, the hoisting ropes are caused to wrap around the traction sheave 411 with a large contact angle. For example, in the case presented in FIG. 4, a contact angle well over 180°, i.e. about 270° between the traction sheave 411 and the hoisting ropes is achieved. X Wrap roping presented in the figure can also be arranged in another way, e.g. by providing two diverting pulleys at appropriate positions near the drive machine. In FIG. 4, diverting pulley 422 has been fitted in place at an angle relative to the traction sheave 807 such that the ropes will run crosswise in a manner known in itself so that the ropes are not damaged. In this figure, the passage of the hoisting ropes from diverting pulley 413 is so arranged that ropes run via the rope grooves of diverting pulley 422 to the traction sheave 411 of the drive machine 410, wrapping around it along the traction sheave rope grooves. From the traction sheave 411, the ropes 403 go further downwards, passing crosswise with the ropes going upwards and further downwards via the rope grooves of the diverting pulley to diverting pulley 407.

Figure 5:
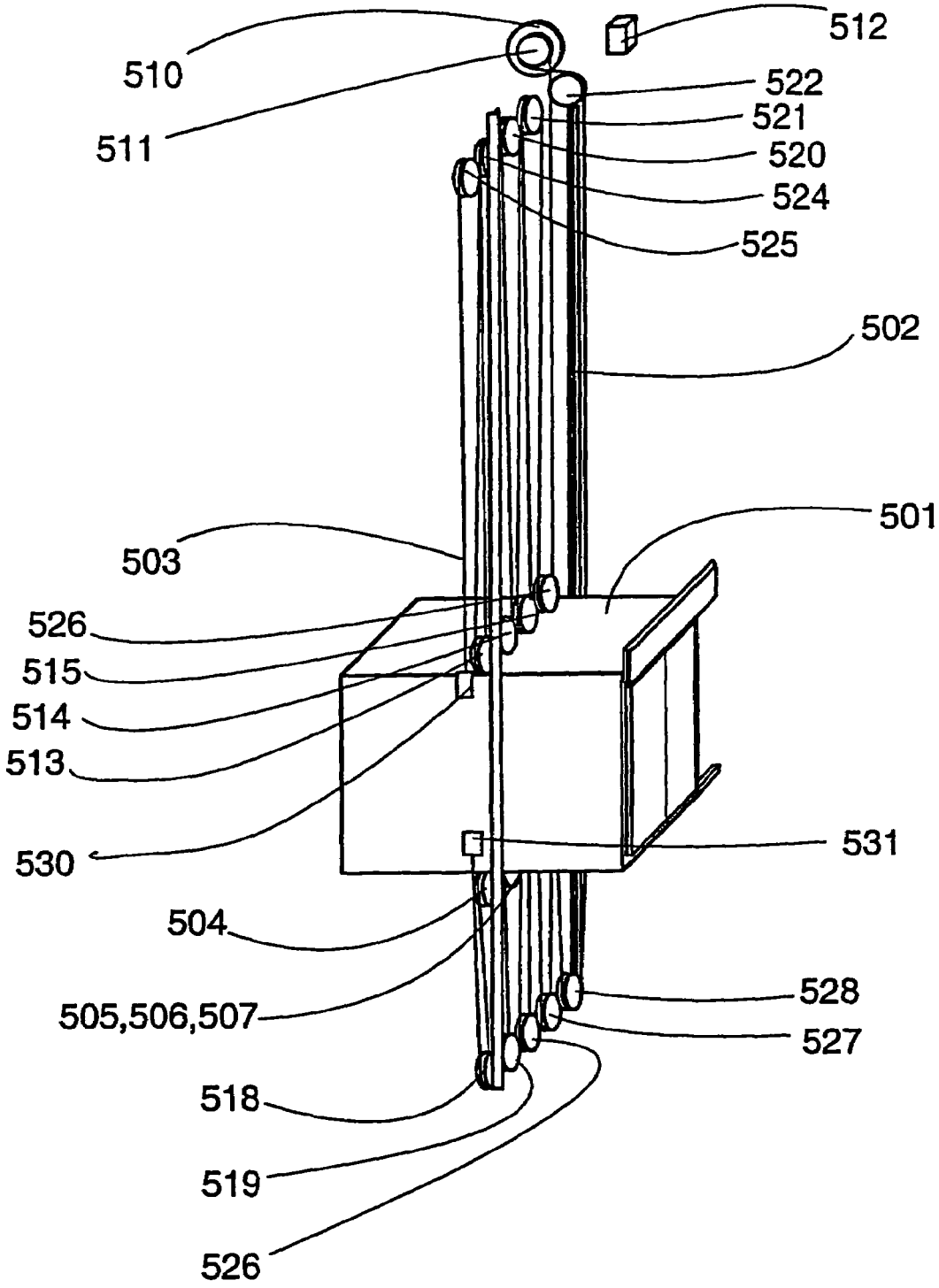
FIG. 5 presents a diagram representing a traction sheave elevator according to the invention.

FIG. 5 presents 1 a diagram illustrating the structure of an elevator according to the invention. The elevator is preferably an elevator without machine room, with a drive machine 510 placed in the elevator shaft. The elevator shown in the figure is a traction sheave elevator with machine above and with a 9:1 suspension ratio both above and below the elevator car. The passage of the hoisting ropes 503 of the elevator is as follows: One end of the ropes is substantially immovably fixed relative to the elevator car at a fixing point 530 so as to be movable with the elevator car, from where the ropes go upwards to a diverting pulley 525 in the upper part of the shaft, from which pulley they run further in the manner described above between diverting pulleys 525, 513, 524, 514, 520, 515, 521, 526, and from which diverting pulleys the ropes 503 go further to the traction sheave 511 of the drive machine 510, passing around it along the rope grooves of the traction sheave. From the traction sheave 511, the hoisting ropes 303 go further downwards, passing crosswise with the ropes going upwards, to diverting pulley 522, passing around it along the rope grooves of the diverting pulley 522. From diverting pulley 522, the ropes 503 go further downwards to a diverting pulley 528 in the lower part of the elevator shaft. The ropes then run further from diverting pulley 528 upwards between the diverting pulleys 504, 505, 506, 507 in the lower part of the elevator car and the diverting pulleys 528, 527, 526, 519, 518 in the lower part of the elevator shaft in the manner described in connection with the preceding figures in FIG. 5, an odd suspension ratio is achieved below the elevator car as well by having the hoisting rope fixed substantially immovably relative to the elevator car at a fixing point 531, to which fixing point is also fitted a mounting element. The roping arrangement used between the traction sheave 511 and diverting pulley 522 is called Extended Single Wrap roping. In Extended Single Wrap roping, the hoisting ropes is caused to wrap around the traction sheave with a larger contact angle by using a diverting pulley. For example, in the case illustrated in FIG. 5, the contact angle between the traction sheave 511 and the hoisting ropes 503 is well over 180°, i.e. about 270°. The Extended Single Wrap roping presented in FIG. 5 can also be arranged in another way, e.g. by disposing the traction sheave and the diverting pulley in a different manner relative to each other, for example the other way round with respect to each other than in FIG. 5. The diverting pulley 522 is fitted in place at an angle relative to the traction sheave 511 such that the ropes pass crosswise in a manner known in itself so that the ropes are not damaged.

Figure 6:
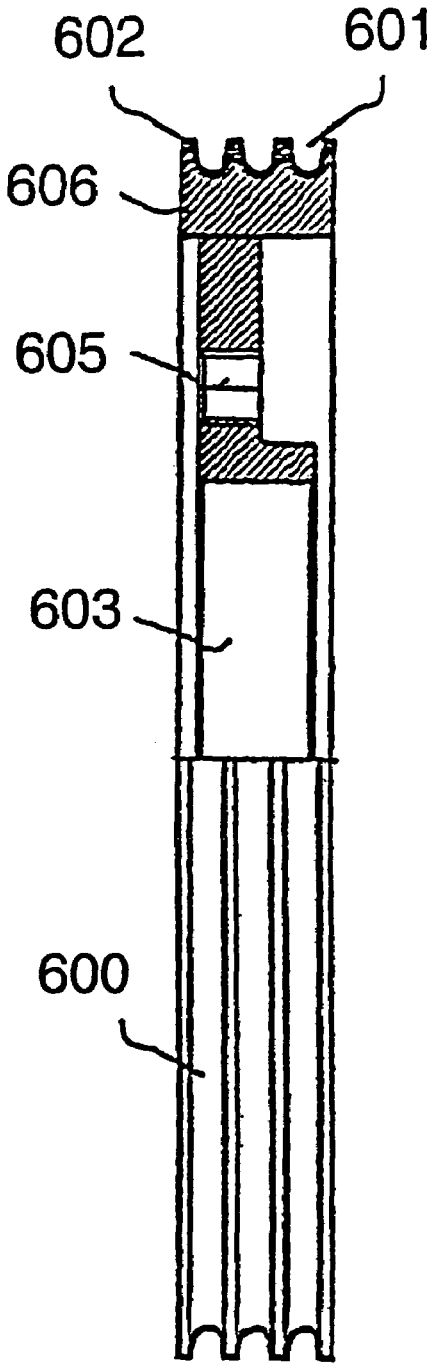
FIG. 6 presents a traction sheave applying the invention.

FIG. 6 presents a partially sectioned view of a rope sheave 600 applying the invention. The rope grooves 601 are under a coating 602 on the rim 606 of the rope sheave. Provided in the hub of the rope sheave is a space 603 for a bearing used to mount the rope sheave. The rope sheave is also provided with holes 605 for bolts, allowing the rope sheave to be fastened by its side to an anchorage in the hoisting machine 10, e.g. to a rotating flange, to form a traction sheave 11, so that no bearing separate from the hoisting machine is needed. The coating material used on the traction sheave and the rope sheaves may consist of rubber, polyurethane or a corresponding elastic material that increases friction. The material of the traction sheave and/or rope sheaves may also be so chosen that, together with the hoisting rope used, it forms a material pair such that the hoisting rope will bite into the pulley after the coating on the pulley has been worn out. This ensures a sufficient grip between the rope sheave 600 and the hoisting rope 3 in an emergency where the coating 602 has been worn out from the rope sheave 600. This feature allows the elevator to maintain its functionality and operational reliability in the situation referred to. The traction sheave and/or the rope sheaves can also be manufactured in such manner that only the rim 606 of the rope sheave 600 is made of a material forming a grip increasing material pair with the hoisting rope 3. The use of strong hoisting ropes that are considerably thinner than normally allows the traction sheave and the rope sheaves to be designed to considerably smaller dimensions and sizes than when normal-sized ropes are used. This also makes it possible to use a motor of a smaller size with a lower torque as the drive motor of the elevator, which leads to a reduction in the acquisition costs of the motor. For example, in an elevator according to the invention designed for a nominal load below 1000 kg, the traction sheave diameter is preferably 120–200 mm, but it may even be less than this. The traction sheave diameter depends on the thickness of the hoisting ropes used. In the elevator of the invention, the use of small traction sheaves, e.g. in the case of elevators for a nominal load below 1000 kg, makes it possible to achieve a machine weight even as low as about one half of the weight of currently used machines, which means producing elevator machines weighing 100–150 kg or even less. In the invention, the machine is understood as comprising at least the traction sheave, the motor, the machine housing structures and the brakes. The traction sheave diameter depends on the thickness of the hoisting ropes used. Conventionally a diameter ratio D/d=40 or higher is used, where D=traction sheave diameter and d=hoisting rope thickness. At the expense of wear resistance of the rope, this ratio can be reduced somewhat. Alternatively, without compromising the service life of the ropes, the D/d ratio can be reduced if at the same time the number of ropes is increased, in which case the stress per rope will be smaller. Such a D/d ratio below 40 could be e.g. a D/d ratio of about 30 or even less, e.g. D/d=25. Often however, reducing the D/d ratio considerably below 30 radically reduces the useful life of the rope, although this can be compensated by using ropes of special structure. Achieving a D/d ratio below 20 is in practice very difficult, but it might be accomplished by using a rope specially designed for this purpose, although such a rope would very probably be expensive.

The weight of the elevator machine and its supporting elements used to hold the machine in place in the elevator shaft is at most about ⅕ of the nominal load. If the machine is exclusively or almost exclusively supported by one or more elevator guide rails, then the total weight of the machine and its supporting elements may be less than about ⅙ or even less than ⅛ of the nominal load. Nominal load of an elevator means a load defined for elevators of a given size. The supporting elements of the elevator machine may include e.g. a beam, carriage or suspension bracket used to support or suspend the machine on/from a wall structure or ceiling of the elevator shaft or on the elevator guide rails, or clamps used to secure the machine to the sides of the elevator guide rails. It will be easy to achieve an elevator in which the machine deadweight without supporting elements is below ⅐ of the nominal load or even about 1/10 of the nominal load or still less. As an example of machine weight in the case of an elevator of a given nominal weight for a nominal load of 630 kg, the combined weight of the machine and its supporting elements may be only 75 kg when the traction sheave diameter is 160 mm and hoisting ropes having a diameter of 4 mm are used, in other words, the total weight of the machine and its supporting elements is about ⅛ of the nominal load of the elevator. As another example, with the same 160 mm traction sheave diameter and the same 4 mm hoisting rope diameter, in the case of an elevator for a nominal load of about 1000 kg, the total weight of the machine and its suspension elements is about 150 kg, so in this case the machine and its supporting elements have a total weight equaling about ⅙ of the nominal load. As a third example, in an elevator designed for a nominal load of 1600 kg and with a traction sheave diameter of 240 mm and a hoisting rope diameter of 6 mm, the total weight of the machine and its supporting elements will be about 300 kg, in other words, the total weight of the machine and its supporting elements equals about ⅐ of the nominal load. By varying the hoisting rope suspension arrangements, it is possible to reach a still lower total weight of the machine and its supporting elements. For example, when a 4:1 suspension ratio, a 160 mm traction sheave diameter and a 4 mm hoisting rope diameter are used in an elevator designed for a nominal load of 500 kg, a total weight of hoisting machine and its supporting elements of about 50 kg will be achieved. In this case, the total weight of the machine and its supporting elements is as small as only about 1/10 of the nominal load. When the size of the traction sheave is substantially reduced and a higher suspension ratio is used, the torque output required of the motor falls to a fraction as compared to the starting situation. For example, if instead of 2:1 suspension a 4:1 suspension ratio is used and if instead of traction sheave with diameter of 400 mm a 160-mm traction sheave is used, then, if the increased losses are disregarded, the torque requirement falls to one fifth. Therefore, the machine size is also really considerably reduced.

Figure 7:
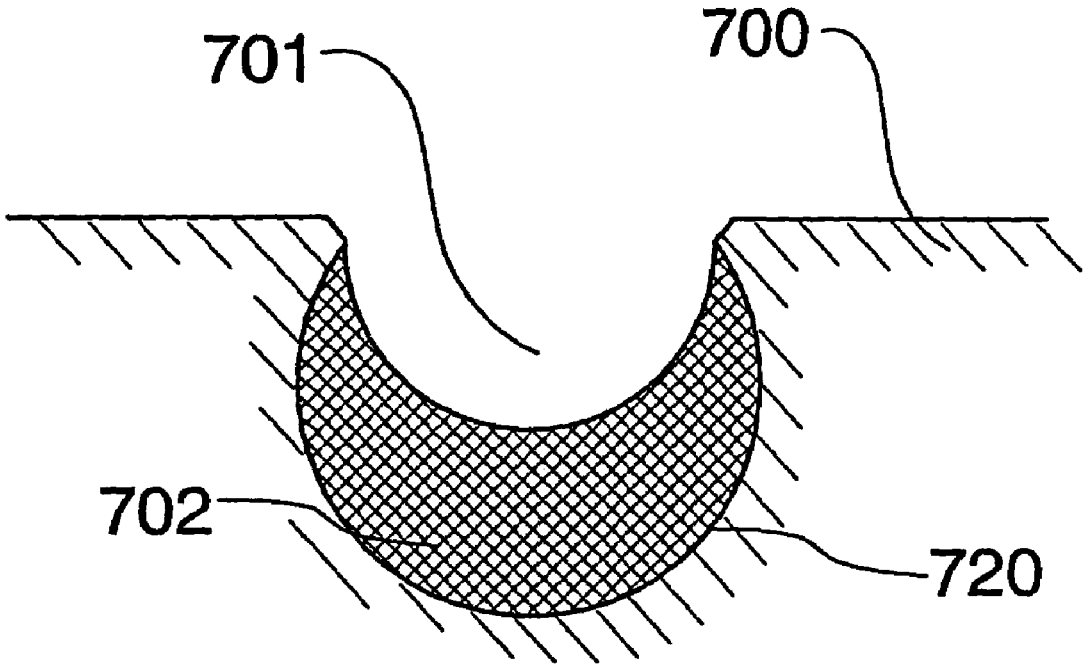
FIG. 7 illustrates a coating solution according to the invention.

FIG. 7 presents a solution in which the rope groove 701 is in the coating 702, which is thinner at the sides of the rope groove than at the bottom. In such a solution, the coating is placed in a basic groove 720 provided in the rope sheave 700 so that deformations produced in the coating by the pressure imposed on it by the rope will be small and mainly limited to the rope surface texture sinking into the coating. Such a solution often means in practice that the rope sheave coating consists of rope groove-specific sub-coatings separate from each other, but considering manufacturing or other aspects it may be appropriate to design the rope sheave coating so that it extends continuously over a number of grooves.

By making the coating thinner at the sides of the groove than at its bottom, the stress imposed by the rope on the bottom of the rope groove while sinking into the groove is avoided or at least reduced. As the pressure cannot be discharged laterally but is directed by the combined effect of the shape of the basic groove 720 and the thickness variation of the coating 702 to support the rope in the rope groove 7301, lower maximum surface pressures acting on the rope and the coating are also achieved. One method of making a grooved coating 702 like this is to fill the round-bottomed basic groove 720 with coating material and then form a half-round rope groove 701 in this coating material in the basic groove. The shape of the rope grooves is well supported and the load-bearing surface layer under the rope provides a better resistance against lateral propagation of the compression stress produced by the ropes. The lateral spreading or rather adjustment of the coating caused by the pressure is promoted by thickness and elasticity of the coating and reduced by hardness and eventual reinforcements of the coating. The coating thickness on the bottom of the rope groove can be made large, even as large as half the rope thickness, in which case a hard and inelastic coating is needed. On the other hand, if a coating thickness corresponding to only about one tenth of the rope thickness is used, then the coating material may be clearly softer. An elevator for eight persons could be implemented using a coating thickness at the bottom of the groove equal to about one fifth of the rope thickness if the ropes and the rope load are chosen appropriately. The coating thickness should equal at least 2–3 times the depth of the rope surface texture formed by the surface wires of the rope. Such a very thin coating, having a thickness even less than the thickness of the surface wire of the hoisting rope, will not necessarily endure the strain imposed on it. In practice, the coating must have a thickness larger than this minimum thickness because the coating will also have to receive rope surface variations rougher than the surface texture. Such a rougher area is formed e.g. where the level differences between rope strands are larger than those between wires. In practice, a suitable minimum coating thickness is about 1–3 times the surface wire thickness. In the case of the ropes normally used in elevators, which have been designed for a contact with a metallic rope groove and which have a thickness of 8–10 mm, this thickness definition leads to a coating at least about 1 mm thick. Since a coating on the traction sheave, which causes more rope wear than the other rope sheaves of the elevator, will reduce rope wear and therefore also the need to provide the rope with thick surface wires, the rope can be made smoother. Rope smoothness can naturally be improved by coating the rope with a material suited for this purpose, such as e.g. polyurethane or equivalent. The use of thin wires allows the rope itself to be made thinner, because thin steel wires can be manufactured from a stronger material than thicker wires. For instance, using 0.2 mm wires, a 4 mm thick elevator hoisting rope of a fairly good construction can be produced. Depending on the thickness of the hoisting rope used and/or on other factors, the wires in the steel wire rope may preferably have a thickness between 0.15 mm and 0.5 mm, in which range there are readily available steel wires with good strength properties in which even an individual wire has a sufficient wear resistance and a sufficiently low susceptibility to damage. In the above, ropes made of round steel wires have been discussed. Applying the same principles, the ropes can be wholly or partly twisted from non-round profiled wires. In this case, the cross-sectional areas of the wires are preferably substantially the same as for round wires, i.e. in the range of 0.015 $mm^2$–0.2 $mm^2$. Using wires in this thickness range, it will be easy to produce steel wire ropes having a wire strength above about 2000 $N/mm^2$ and a wire cross-section of 0.015 $mm^2$–0.2

$mm^2$ and comprising a large cross-sectional area of steel material in relation to the cross-sectional area of the rope, as is achieved e.g. by using the Warrington construction. For the implementation of the invention, particularly well suited are ropes having a wire strength in the range of 2300 $N/m^2$–2700 $N/mm^2$, because such ropes have a very large bearing capacity in relation to rope thickness while the high hardness of the strong wires involves no substantial difficulties in the use of the rope in elevators. A traction sheave coating well suited for such a rope is already clearly below 1 mm thick. However, the coating should be thick enough to ensure that it will not be very easily scratched away or pierced e.g. by an occasional sand grain or similar particle that may have got between the rope groove and the hoisting rope. Thus, a desirable minimum coating thickness, even when thin-wire hoisting ropes are used, would be about 0.5 . . . 1 mm. For hoisting ropes having small surface wires and an otherwise relatively smooth surface, a coating having a thickness of the form A+Bcosa is well suited. However, such a coating is also applicable to ropes whose surface strands meet the rope groove at a distance from each other, because if the coating material is sufficiently hard, each strand meeting the rope groove is in a way separately supported and the supporting force is the same and/or as desired. In the formula A+B cosa, A and B are constants so that A+B is the coating thickness at the bottom of the rope groove 701 and the angle a is the angular distance from the bottom of the rope groove as measured from the center of curvature of the rope groove cross-section. Constant A is larger than or equal to zero, and constant B is always larger than zero. The thickness of the coating growing thinner towards the edges can also be defined in other ways besides using the formula A+B cosa so that the elasticity decreases towards the edges of the rope groove. The elasticity in the central part of the rope groove can also be increased by making an undercut rope groove and/or by adding to the coating on the bottom of the rope groove a portion of different material of special elasticity, where the elasticity has been increased, in addition to increasing the material thickness, by the use of a material that is softer than the rest of the coating.

Figure 8A:
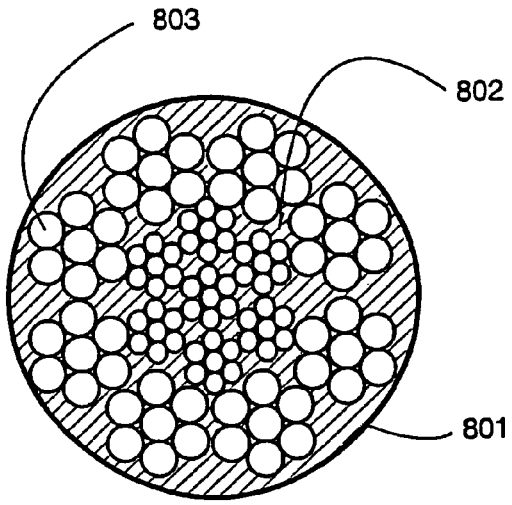
FIG. 8*a* presents a steel wire rope used in the invention.
Figure 8B:
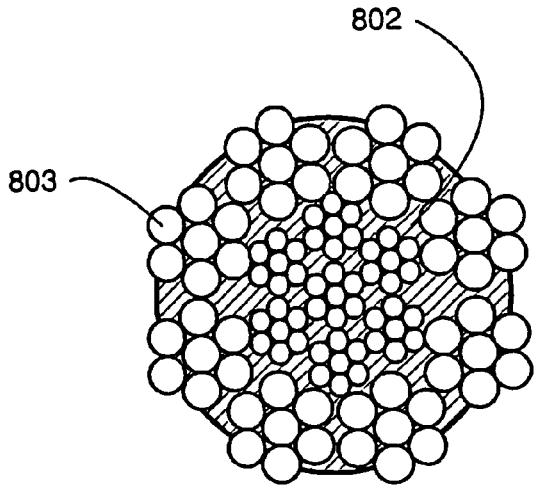
FIG. 8*b* presents a second steel wire rope used in the invention.
Figure 8C:
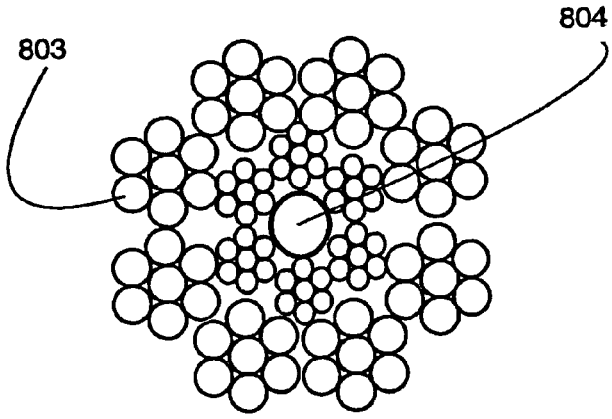
FIG. 8*c* presents a third steel wire rope used in the invention, FIG. 9 present some traction sheave roping arrangements according to the invention.

FIGS. 8*a*, 8*b* and 8*c* present cross-sections of steel wire ropes used in the invention. The ropes in these figures contain thin steel wires 803, a coating 802 on the steel wires and/or partly between the steel wires, and in FIG. 8*a* a coating 801 over the steel wires. The rope presented in FIG. 8*b* is an uncoated steel wire rope with a rubber-like filler added to its interior structure, and FIG. 8*a* presents a steel wire rope provided with a coating in addition to a filler added to the internal structure. The rope presented in FIG. 8*c* has a non-metallic core 804, which may be a solid or fibrous structure made of plastic, natural fiber or some other material suited for the purpose. A fibrous structure will be good if the rope is lubricated, in which case lubricant will accumulate in the fibrous core. The core thus acts as a kind of lubricant storage. The steel wire ropes of substantially round cross-section used in the elevator of the invention may be coated, uncoated and/or provided with a rubber-like filler, such as e.g. polyurethane or some other suitable filler, added to the interior structure of the rope and acting as a kind of lubricant lubricating the rope and also balancing the pressure between wires and strands. The use of a filler makes it possible to achieve a rope that needs no lubrication, so its surface can be dry. The coating used in the steel wire ropes may be made of the same or nearly the same material as the filler or of a material that is better suited for use as a coating and has properties, such as friction and wear resistance properties, that are better suited to the purpose than a filler. The coating of the steel wire rope may also be so implemented that the coating material penetrates partially into the rope or through the entire thickness of the rope, giving the rope the same properties as the filler mentioned above. The use of thin and strong steel wire ropes according to the invention is possible because the steel wires used are wires of special strength, allowing the ropes to be made substantially thin as compared with steel wire ropes used before. The ropes presented in FIGS. 8*a* and 8*b* are steel wire ropes having a diameter of about 4 mm. For example, the thin and strong steel wire ropes of the invention preferably have a diameter of about 2.5–5 mm in elevators for a nominal load below 1000 kg, and preferably about 5–8 mm in elevators for a nominal load above 1000 kg. In principle, it is possible to use ropes thinner than this, but in this case a large number of ropes will be needed. Still, by increasing the suspension ratio, ropes thinner than those mentioned above can be used for corresponding loads, and at the same time a smaller and lighter elevator machine can be achieved.

In the elevator of the invention, it is also possible use ropes having a diameter of over 8 mm if necessary. Likewise, ropes of a diameter below 3 mm can be used.

FIGS. 9*a*, 9*b*, 9*c*, 9*d*, 9*e*, 9*f* and 9*g* present some variations of the roping arrangements according to the invention that can be used between the traction sheave 907 and the diverting pulley 915 to increase the contact angle between the ropes 903 and the traction sheave 907, in which arrangements the ropes 903 go downwards from the drive machine 906 towards the elevator car and diverting pulleys. These roping arrangements make it possible to increase the contact angle between the hoisting rope 903 and the traction sheave 907. In the invention, contact angle $\alpha$ refers to the length of the arc of contact between the traction sheave and the hoisting rope. The magnitude of the contact angle $\alpha$ may be expressed e.g. in degrees, as is done in the invention, but it is also possible to express the magnitude of the contact angle in other terms, e.g. in radians or equivalent. The contact angle $\alpha$ is presented in greater detail in FIG. 9*a*. In the other figures, the contact angle $\alpha$ is not expressly indicated, but it can be seen from the other figures as well without specific separate description.

Figure 9A:
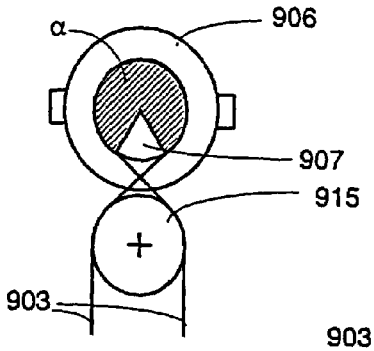
Figure 9B:
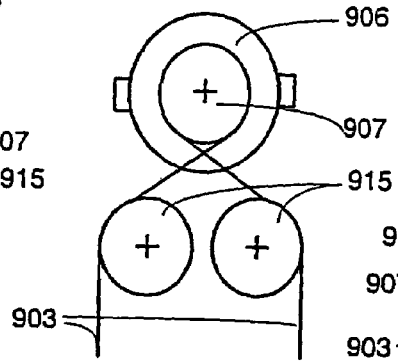
Figure 9C:
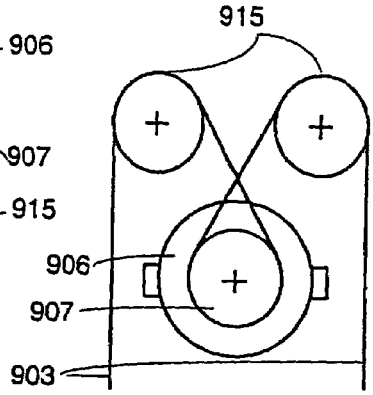

The roping arrangements presented in FIGS. 9*a*, 9*b*, 9*c* represent some variations of the X Wrap roping described above. In the arrangement presented in FIG. 9*a*, the ropes 903 come via diverting pulley 915, wrapping around it along rope grooves, to the traction sheave 907, over which the ropes pass along its rope grooves and then go further back to the diverting pulley 915, passing crosswise with respect to the rope portion coming from the diverting pulley, and continuing their passage further. Crosswise passage of the ropes 903 between the diverting pulley 915 and the traction sheave 907 can be implemented e.g. by having the diverting pulley fitted at such an angle with respect to the traction sheave that the ropes will cross each other in a manner known in itself so that the ropes 903 are not damaged. In FIG. 9*a*, the shaded area represents the contact angle $\alpha$ between the ropes 903 and the traction sheave 907. The magnitude of the contact angle $\alpha$ in this figure is about 310°. The size of the diameter of the diverting pulley can be used as a means of determining the distance of suspension that is to be provided between the diverting pulley 915 and the traction sheave 907. The magnitude of the contact angle can be varied by varying the distance between the diverting pulley 915 and the traction sheave 907. The magnitude of the angle $\alpha$ can also be varied by varying the diameter of the diverting pulley and/or by varying the diameter of the traction sheave and also by varying the ratio between the diameters of the diverting pulley and the traction sheave. FIGS. 9*b* and 9*c* present an example of implementing a corresponding XW roping arrangement using two diverting pulleys.

Figure 9D:
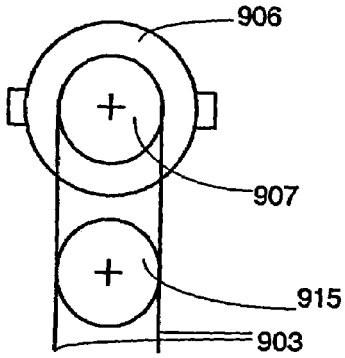
Figure 9E:
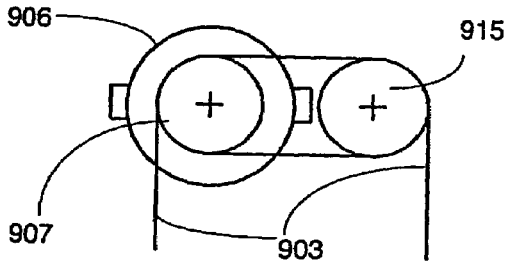

The roping arrangements presented in FIGS. 9*d* and 9*e* are different variations of the above-mentioned Double Wrap roping. In the roping arrangement in FIG. 9*d*, the ropes run via the rope grooves of a diverting pulley 915 to the traction sheave traction sheave 907 of the drive machine 906, passing over it along the rope grooves of the traction sheave. From the traction sheave 907, the ropes 903 go further downwards back to the diverting pulley 915, wrapping around it along the rope grooves of the diverting pulley and returning then back to the traction sheave 907, over which the ropes run in the rope grooves of the traction sheave. From the traction sheave 907, the ropes 903 run further downwards via the rope grooves of the diverting pulley. In the roping arrangement presented in the figure, the hoisting ropes are caused to wrap around the traction sheave twice and/or more times. By these means, the contact angle can be increased in two and/or more stages. For example, in the case presented in FIG. 9*d*, a contact angle of 180°+180° between the traction sheave 907 and the ropes 903 is achieved. In Double Wrap roping, when the diverting pulley 915 is substantially of equal size with the traction sheave 907, the diverting pulley 915 also functions as a damping wheel. In this case, the ropes going from the traction sheave 907 to the diverting pulleys and elevator car pass via the rope grooves of diverting pulley 915 and the rope deflection produced by the diverting pulley is very small. It could be said that the ropes coming from the traction sheave only touch the diverting pulley tangentially. Such tangential contact serves as a solution damping the vibrations of the outgoing ropes and it can be applied in other roping arrangements as well. In this case, the diverting pulley 915 also functions as a rope guide. The ratio of the diameters of the diverting pulley and traction sheave can be varied by varying the diameters of the diverting pulley and/or traction sheave. This can be used as a means of defining the magnitude of the contact angle and fitting it to a desired magnitude. By using DW roping, forward bending of the rope 903 is achieved, which means that in DW roping the rope 903 is bent in the same direction on the diverting pulley 915 and on the traction sheave 907. DW roping can also be implemented in other ways, such as e.g. the way illustrated in FIG. 9*e*, where the diverting pulley 915 is disposed on the side of the drive machine 906 and the traction sheave 907. In this roping arrangement, the ropes 903 are passed in a manner corresponding to FIG. 9*d*, but in this case a contact angle of 180°+90°, i.e. 270° is obtained. In DW roping, if the diverting pulley 915 is placed on the side of the traction sheave, greater demands are imposed on the bearings and mounting of the diverting pulley because it is exposed to greater stress and load forces than in the embodiment presented in FIG. 9*d*.

Figure 9F:
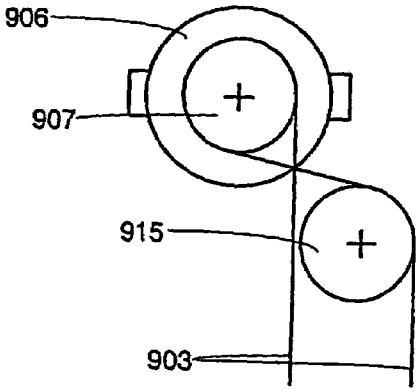
Figure 9G:
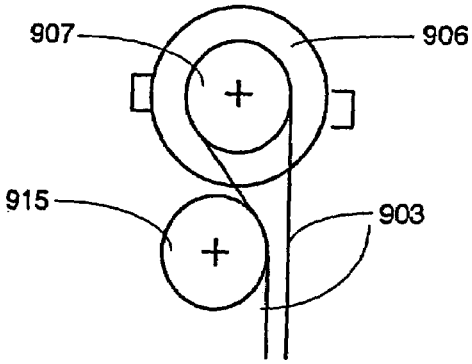

FIG. 9*f* presents an embodiment of the invention applying Extended Single Wrap roping as mentioned above. In the roping arrangement presented in FIG. 9*f*, the ropes 903 run to the traction sheave 907 of the drive machine 906, wrapping around it along the rope grooves of the traction sheave. From the traction sheave 907, the ropes 903 go further downwards, running crosswise relative to the upwards going ropes and further to a diverting pulley 915, passing over it along the rope grooves of the diverting pulley 915. From the diverting pulley 915, the ropes 903 run further on. In Extended Single Wrap roping, by using a diverting pulley, the hoisting ropes are caused to wrap around the traction sheave with a larger contact angle than in ordinary Single Wrap roping. For example, in the case illustrated in FIG. 9*f*, a contact angle of about 270° between the ropes 903 and the traction sheave 907 is obtained. The diverting pulley 915 is fitted in place at an angle such that the ropes run crosswise in a manner known in itself, so that the ropes are not damaged. By virtue of the contact angle achieved using Extended Single Wrap roping, elevators implemented according to the invention can use a very light elevator car. One possibility of increasing the contact angle is illustrated in FIG. 9*g*, where the hoisting ropes do not run crosswise relative to each other after wrapping around the traction sheave and/or diverting pulley. By using a roping arrangement like this, it is also possible to increase the contact angle between the hoisting ropes 903 and the traction sheave 907 of the drive machine 906 to a magnitude substantially over 180°.

FIGS. 9*a,b,c,d,f* and *g* present different variations of roping arrangements between the traction sheave and the diverting pulley/diverting pulleys, in which the ropes go downwards from the drive machine towards the counterweight and the elevator car. In the case of an elevator embodiment according to the invention with machine below, these roping arrangements can be inverted and implemented in a corresponding manner so that the ropes go upwards from the elevator drive machine towards the diverting pulleys and the elevator car.

Figure 10:
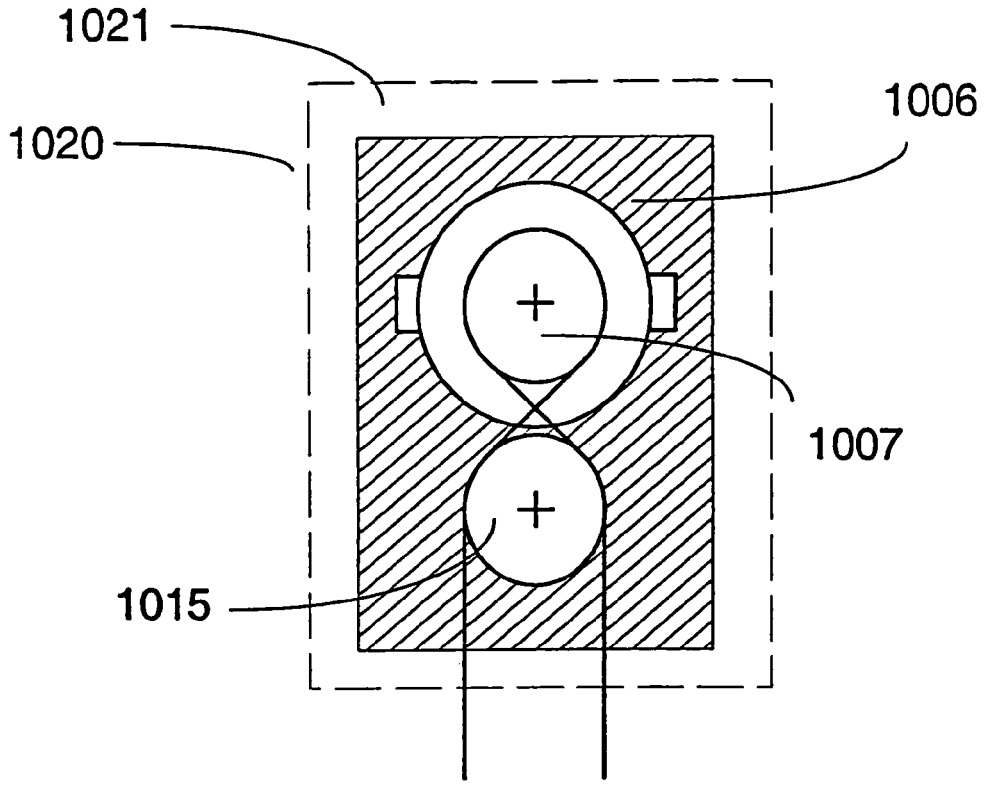
FIG. 10 presents an embodiment of the invention.

FIG. 10 presents yet another embodiment of the invention, wherein the elevator drive machine 1006 is fitted together with a diverting pulley 1015 on the same mounting base 1021 in a ready-made unit 1020, which can be fitted as such to form a part of an elevator according to the invention. The unit 1020 contains the elevator drive machine 1006, the traction sheave 1007 and diverting pulley 1015 ready-fitted on the mounting base 1021, the traction sheave and diverting pulley being ready fitted at a correct operating angle relative to each other, depending on the roping arrangement used between the traction sheave 1007 and the diverting pulley 1015. The unit 1020 may comprise more than only one diverting pulley 1015, or it may only comprise the drive machine 1006 fitted on the mounting base 1021. The unit can be mounted in an elevator according to the invention like a drive machine, the mounting arrangement being described in greater detail in connection with the previous figures. If necessary, the unit can be used together with any of the roping arrangements described above, such as e.g. embodiments using ESW, DW, SW or XW roping. By fitting the above-described unit as part of an elevator according to the invention, considerable savings can be made in installation costs and in the time required for installation.

Figure 11:
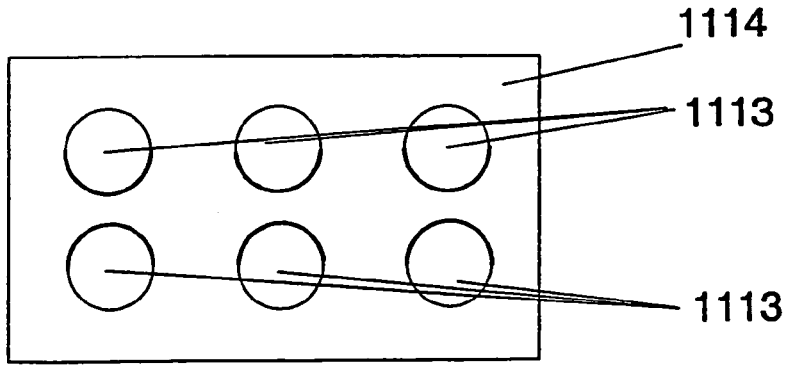
FIG. 11 presents an embodiment of the invention.

FIG. 11 presents an embodiment of the invention wherein the diverting pulley 1113 of the elevator is fitted in a ready-made unit 1114, which unit may be placed in the upper part and/or in the lower part of the shaft and/or in the elevator car, and in which unit it is possible to fit several diverting pulleys. By means of this unit, faster roping is achieved and the diverting pulleys can be disposed compactly to form a single structure in a desired place. The unit can be provided with an unlimited number of diverting pulleys, and these can be fitted in a desired angle in the unit.

Figure 12:
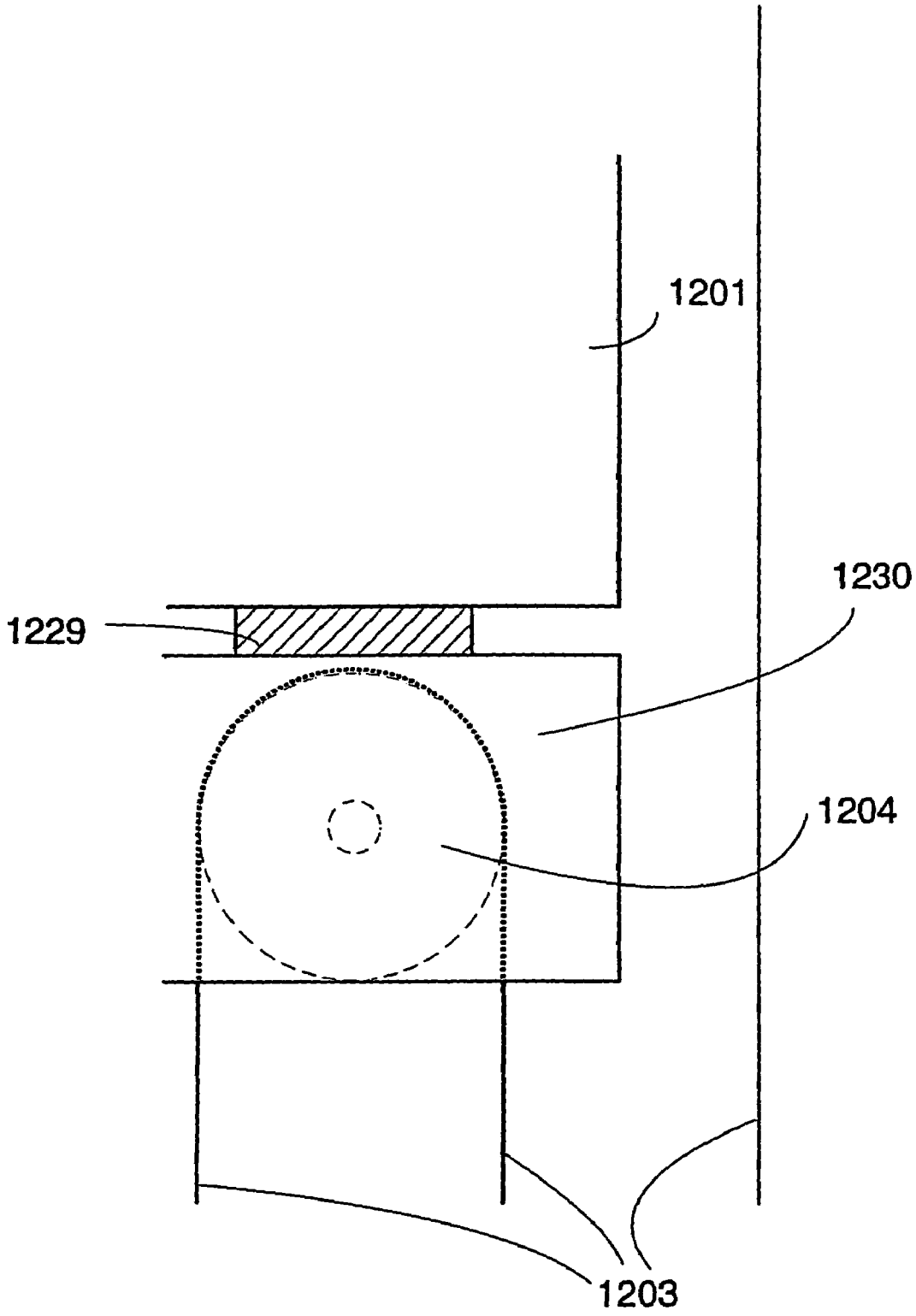
FIG. 12 presents a diagram of a rope sheave placement according to the invention.

FIG. 12 shows how the rope sheave 1204 serving to suspend the elevator car and its structures and mounted on a horizontal beam 1230 comprised in the structure supporting the elevator car 1201 is disposed with respect to the beam 1230. The rope sheave 1204 shown in the figure may have a height equal to or smaller than that of the beam 1230 comprised in the structure. The beam 1230 supporting the elevator car 1201 may be placed either below or above the elevator car. The rope sheave 1204 may be placed completely or at least partially inside the beam 1230, as illustrated in the figure. The passage of the elevator hoisting ropes 1203 in this figure is as follows. The hoisting ropes 1203 come to the coated rope sheave 1204 mounted on the beam 1230 comprised in the structure supporting the elevator car 1201, from where the hoisting rope runs further along the rope grooves of the rope sheave, protected by the beam. The elevator car 1201 rests on the beam 1230 comprised in the structure, on vibration absorbers 1229 placed between them. The beam 1230 functions at the same time as a rope guard for the hoisting rope 1203. The beam 1230 may be a C-, U-, I-, Z-shaped beam or a hollow beam or equivalent. The beam 1230 may support several rope sheaves fitted on it and serving as diverting pulleys in different embodiments of the invention.

A preferred embodiment of the elevator of the invention is an elevator with machine above without machine room, the drive machine of which comprises a coated traction sheave and which uses thin hoisting ropes of substantially round cross-section. The contact angle between the hoisting ropes of the elevator and the traction sheave is larger than 180°. The elevator comprises a unit comprising a mounting base with a drive machine, a traction sheave and a diverting pulley ready fitted on it, said diverting pulley being fitted at a correct angle relative to the traction sheave. The unit is secured to the elevator guide rails. The elevator is implemented without counterweight with a 9:1 suspension ratio so that the elevator ropes run in the space between one of the walls of the elevator car and the wall of the elevator shaft.

Another preferred embodiment of the elevator of the invention is an elevator without counterweight with a suspension ratio of 10:1 above and below the elevator car. This embodiment is implemented using conventional hoisting ropes preferably of a diameter of 8 mm and a traction sheave made of cast iron at least in the area of the rope grooves. The traction sheave has undercut rope grooves and its angle of contact to the traction sheave has been fitted by means of a diverting pulley to be 180° or greater. When conventional 8-mm ropes are used, the traction sheave diameter is preferably 340 mm. The diverting pulleys used are large rope sheaves which, in the case of conventional 8-mm hoisting ropes, have a diameter of 320, 330, 340 mm or even more.

It is obvious to the person skilled in the art that different embodiments of the invention are not limited to the examples described above, but that they may be varied within the scope of the following claims. For instance, the number of times the hoisting ropes are passed between the upper part of the elevator shaft and the elevator car and between the diverting pulleys in the lower part and the elevator car is not a very decisive question as regards the basic advantages of the invention, although it is possible to achieve some additional advantages by using multiple rope passages. In general, applications are so implemented that the ropes go to the elevator car from above as many times as from below, the suspension ratios of the diverting pulleys going upwards and those the diverting pulleys going downwards thus being the same. It is also obvious that the hoisting ropes need not necessarily be passed under the car. In accordance with the examples described above, the skilled person can vary the embodiment of the invention, while the traction sheaves and rope sheaves, instead of being coated metal sheaves, may also be uncoated metal sheaves or uncoated sheaves made of some other material suited to the purpose.

It is further obvious to the person skilled in the art that the metallic traction sheaves and rope sheaves used in the invention, which are coated with a non-metallic material at least in the area of their grooves, may be implemented using a coating material consisting of e.g. rubber, polyurethane or some other material suited to the purpose.

It is also obvious to the person skilled in the art that the elevator car and the machine unit may be laid out in the cross-section of the elevator shaft in a manner differing from the lay-out described in the examples. Such a different lay-out might be e.g. one in which the machine is located behind the car as seen from the shaft door and the ropes are passed under the car diagonally relative to the bottom of the car. Passing the ropes under the car in a diagonal or otherwise oblique direction relative to the form of the bottom provides an advantage when the suspension of the car on the ropes is to be made symmetrical relative to the center of gravity of the elevator in other types of suspension lay-out as well.

It is further obvious to the person skilled in the art that the equipment required for the supply of power to the motor and the equipment needed for elevator control can be placed elsewhere than in connection with the machine unit, e.g. in a separate instrument panel. It is also possible to fit pieces of equipment needed for control into separate units which can then be disposed in different places in the elevator shaft and/or in other parts of the building. It is likewise obvious to the skilled person that an elevator applying the invention may be equipped differently from the examples described above. It is further obvious to the skilled person that the suspension solutions according to the invention can also be implemented using almost any type of flexible hoisting means as hoisting ropes, e.g. flexible rope of one or more strands, flat belt, cogged belt, trapezoidal belt or some other type of belt applicable to the purpose.

It is also obvious to the skilled person that, instead of using ropes with a filler as illustrated in FIGS. 5*a* and 5*b*, the invention may be implemented using ropes without filler, which are either lubricated or unlubricated. In addition, it is also obvious to the person skilled in the art that the ropes may be twisted in many different ways.

It is also obvious to the skilled person that the average of the wire thicknesses may be understood as referring to a statistical, geometrical or arithmetical mean value. To determine a statistical average, the standard deviation or Gauss distribution can be used. It is further obvious that the wire thicknesses in the rope may vary, e.g. even by a factor of 3 or more.

It is also obvious to the person skilled in the art that the elevator of the invention can be implemented using different roping arrangements for increasing the contact angle $\alpha$ between the traction sheave and the diverting pulley/diverting pulleys than those described as examples. For example, it is possible to dispose the diverting pulley/diverting pulleys, the traction sheave and the hoisting ropes in other ways than in the roping arrangements described in the examples. It is also obvious to the skilled person that in the elevator of the invention the elevator can also be provided with a counterweight, in which elevator for example the counterweight preferably has a weight below that of the car and is suspended with separate roping.

The invention claimed is:

1. An elevator having no counterweights comprising a hoisting machine engaging a set of hoisting ropes by a traction sheave, an elevator car being at least partially supported by said hoisting ropes for moving the elevator car, wherein the elevator car is suspended by the hoisting ropes via at least one diverting pulley from a rim of which the hoisting ropes go upwards from both sides of the diverting pulley, and at least another diverting pulley from a rim of which the hoisting ropes go downwards from both sides of the other diverting pulley, and in which the traction sheave engages a rope portion between the diverting pulleys, and a rope tensioning element for adjusting the rope tension engaged at one end of the hoisting ropes.

2. The elevator according to claim 1, wherein one end of the hoisting ropes is fastened substantially immovably with respect to the elevator car so as to be movable with the elevator car.

3. The elevator according to claim 1, wherein at least one end of the hoisting ropes is fastened substantially immovably with respect to the elevator shaft.

4. The elevator according to claim 1, wherein the elevator comprises at least two diverting pulleys from which the hoisting ropes go upwards and at least two diverting pulleys from which the hoisting ropes go downwards.

5. The elevator according to claim 1, wherein both ends of the hoisting ropes are fastened substantially immovably with respect to the elevator shaft.

6. The elevator according to claim 1, wherein both ends of the hoisting ropes are fastened substantially immovably with respect to the elevator car.

7. The elevator according to claim 1, wherein a continuous angle of contact between the traction sheave and the hoisting ropes is at least 180°.

8. The elevator according to claim 1, wherein a continuous angle of contact between the traction sheave and the hoisting ropes is greater than 180°.

9. The elevator according to claim 1, wherein a roping used between the traction sheave and a rope sheave serving as a diverting pulley is an extended single wrap (ESW) roping.

10. The elevator according to claim 1, wherein a roping used between the traction sheave and a rope sheave serving as a diverting pulley is a double wrap (DW) roping.

11. The elevator according to claim 1, wherein a roping used between the traction sheave and a rope sheave serving as a diverting pulley is a X-wrap (XW) roping.

12. The elevator according to claim 1, wherein the hoisting ropes are composed from a high-strength material.

13. The elevator according to claim 1, wherein the hoisting ropes is made of steel wires having a strength of between about 2300 $N/mm^2$ and about 2700 $N/mm^2$.

14. The elevator according to claim 1, wherein a cross-sectional area of steel wires of the hoisting ropes is between about 0.015 $mm^2$ and about 0.2 $mm^2$, and a strength of the steel wires of the hoisting ropes is greater than about 2000 $N/mm^2$.

15. The elevator according to claim 1, wherein diameters of the hoisting ropes are smaller than 8 mm.

16. The elevator according to claim 1, wherein a weight of the hoisting machine is lighter in relation to a load of the elevator.

17. The elevator according to claim 1, wherein the traction sheave is coated with at least one of a polyurethane, a rubber and some other frictional material.

18. The elevator according to claim 1, wherein the traction sheave is made of cast iron at least in the area of the rope grooves.

19. The elevator according to claim 1, wherein the elevator is without a machine room.

20. The elevator according to claim 4, wherein the number of diverting pulleys from which the hoisting ropes go upwards and the number of diverting pulleys from which the hoisting ropes go downwards is at least one of 3, 4 and 5.

21. The elevator according to claim 5, wherein both ends of the hoisting ropes are fastened substantially immovably with respect to the elevator shaft by a spring.

22. The elevator according to claim 6, wherein both ends of the hoisting ropes are fastened substantially movably with respect to the elevator car by a spring so as to be immovable by the elevator car.

23. The elevator according to claim 15, wherein the diameters of the hoisting ropes are approximately between 3–5 mm.

24. The elevator according to claim 18, wherein the rope grooves are undercut.

* * * * *